US008926412B2

(12) United States Patent
Bengtsson et al.

(10) Patent No.: US 8,926,412 B2
(45) Date of Patent: Jan. 6, 2015

(54) COIN DEPOSIT AND DISPENSING APPARATUS

(71) Applicant: Scan Coin AB, Malmo (SE)

(72) Inventors: Kristian Bengtsson, Bjarred (SE); Ali Obeid Ali, Malmo (SE); Yazin Kamal Al-Khayyt, Helsingborg (SE); Daniel Kihlbaum, Gothenburg (SE)

(73) Assignee: Scan Coin AB, Malmo (SE)

( * ) Notice: Subject to any disclaimer, the term of this patent is extended or adjusted under 35 U.S.C. 154(b) by 0 days.

(21) Appl. No.: 13/934,765

(22) Filed: Jul. 3, 2013

(65) Prior Publication Data

US 2014/0030972 A1 Jan. 30, 2014

Related U.S. Application Data

(60) Provisional application No. 61/675,913, filed on Jul. 26, 2012.

(30) Foreign Application Priority Data

Jul. 24, 2012 (EP) ..... 12177627

(51) Int. Cl.

| | |
|---|---|
| ***G07D 3/00*** | (2006.01) |
| ***G07F 1/04*** | (2006.01) |
| ***G07D 3/14*** | (2006.01) |
| ***G07D 9/00*** | (2006.01) |
| ***G07D 9/02*** | (2006.01) |
| ***G07D 9/04*** | (2006.01) |

(52) U.S. Cl.

CPC ..... *G07D 3/14* (2013.01); *G07D 9/008* (2013.01); *G07D 9/02* (2013.01); *G07D 9/04* (2013.01)

USPC ..... 453/3; 453/18; 453/30; 194/344

(58) Field of Classification Search

USPC ..... 453/1, 3, 18, 19, 20, 29, 30; 194/344, 194/350, 351; 221/68, 93, 94, 98–100, 174, 221/199, 263, 282, 312 C, 312 R; 193/2 A, 193/2 R, DIG. 1; 232/1 D, 9, 44, 55, 64–66

See application file for complete search history.

(56) References Cited

U.S. PATENT DOCUMENTS 4,275,751 A * 6/1981 Bergman ..... 453/5
4,787,873 A * 11/1988 Borrmann et al. ..... 446/8

(Continued)

FOREIGN PATENT DOCUMENTS

CA 1169734 6/1984 ..... 133/14
GB 14210 6/1911

(Continued)

OTHER PUBLICATIONS

European Search Report Dated Oct. 17, 2012, for Application No. 12177627.2, (6 pages).

(Continued)

*Primary Examiner* — Mark Beauchaine

(74) *Attorney, Agent, or Firm* — Womble Carlyle Sandridge & Rice LLP

(57) ABSTRACT

The present invention provides a coin deposit and dispensing apparatus having a till filling distributor unit comprising a set of a plurality of releasably mounted till filling distributors, each till filling distributor comprising a wide upper opening, a narrow lower opening, and a pipe-like structure between these openings, where the till filling distributor unit is designed in such a way that in a dispensing operation a till filling distributor is located below each dispenser involved in the dispensing operation, whereby each till filling distributor is adapted for receiving coins from a dispenser located above said distributor into the wide upper opening of the distributor and to guide the coins through said narrow lower opening to a portable cash receptacle.

15 Claims, 11 Drawing Sheets

(56) References Cited

U.S. PATENT DOCUMENTS

| | | | | |
|---|---|---|---|---|
| 4,950,203 | A | 8/1990 | Tomaiko | |
| 5,297,598 | A * | 3/1994 | Rasmussen | 141/314 |
| 6,047,807 | A | 4/2000 | Molbak | |
| 6,983,836 | B2 * | 1/2006 | Adams et al. | 194/302 |
| 7,018,285 | B2 | 3/2006 | Enomoto | |
| 7,625,272 | B1 * | 12/2009 | Moreland et al. | 453/3 |
| 2003/0032388 | A1 | 2/2003 | Rasmussen et al. | |
| 2004/0231955 | A1 | 11/2004 | Carter | |
| 2004/0231956 | A1 | 11/2004 | Adams et al. | |
| 2006/0019591 | A1 | 1/2006 | Abe et al. | |
| 2007/0108267 | A1 | 5/2007 | Jonsson et al. | |
| 2008/0090508 | A1 * | 4/2008 | Skoog et al. | 453/3 |

FOREIGN PATENT DOCUMENTS

| | | | | |
|---|---|---|---|---|
| GB | 102491 | | 7/1917 | |
| JP | 2004-326418 | | 11/2004 | G07D 1/00 |
| JP | 2007-280010 | | 10/2007 | G07D 9/00 |
| WO | WO 2005/014046 | A1 | 11/2005 | G07D 9/00 |
| WO | WO 2007/035420 | A2 | 3/2007 | G06F 7/00 |
| WO | WO 2008/024043 | A1 | 2/2008 | G07F 9/06 |

OTHER PUBLICATIONS

European Search Report Dated Oct. 17, 2012, for Application No. 12177631.4, (5 pages).

European Search Report Dated Oct. 17, 2012, for Application No. 12177633.0, (5 pages).

* cited by examiner

COIN DEPOSIT AND DISPENSING APPARATUS

CROSS-REFERENCE TO RELATED APPLICATIONS

This application claims the benefit of European Patent Application No. 12177627.2, filed on Jul. 24, 2012; and claims the benefit of U.S. Provisional Patent Application No. 61/675,913, filed Jul. 26, 2012.

INCORPORATION BY REFERENCE

The entire disclosures of European Patent Application No. 12177627.2, filed on Jul. 24, 2012; and U.S. Provisional Patent Application No. 61/675,913, filed Jul. 26, 2012, are incorporated herein by reference as if set forth in their entireties.

FIELD OF INVENTION

The present invention generally relates to cash handling, and more specifically to coin deposit equipment and coin dispensing equipment.

TECHNICAL BACKGROUND

Retail cash systems (RCS) are used for handling of cash, such as notes (bills), cheques or coupons in a retail establishment. The systems generally comprise a coin deposit apparatus and a coin dispensing apparatus.

The coin deposit apparatus has to discriminate between different types of acceptable coins, such as valid coins in a plurality of denominations in one or more specific currencies. Preferably, it should also be capable of detecting unacceptable cash, such as fake (counterfeit) coins or coins of a foreign currency. In the coin deposit apparatus a coin acceptance module (CAM) handles the discrimination of coins and is also adapted to count the coins to register the deposited amount. One typical user is a cashier emptying a till after a work shift.

The coin dispensing apparatus contains coins of various denominations. It generally dispenses a specified composition or amount of coins based on the input of a user. It also registers the amount of coins dispensed. The coin dispensing apparatus contains several storage receptacles, typically one for each type of denomination to be dispensed, from which coins are dispensed. One typical use case in this context is a cashier filling a till at the beginning of a work shift.

The coin deposit apparatus and the coin dispensing apparatus can be combined into what is called a coin (or cash) recycling system. In order for such a system to work properly the coin acceptance module of the system also includes sorting capabilities, so that different denominations are discriminated and stored separately from each other, while waiting to be dispensed.

The coin recycling system also has a controller keeping track of all transactions occurring in the system. The system can therefore be utilized as the heart of a settlement system for a retail establishment.

WO-05/104046 discloses a cash recycling machine for a retail establishment in accordance with what has been described above. WO-05/104046 describes how a till is placed with its front end supported on a ledge in order to receive multiple denominations in a sorted condition simultaneously. The described system also provides for bagging operations.

WO-2008/024043 relates to a coin deposit and dispensing apparatus having a cabinet serving as an apparatus housing for said apparatus. The apparatus further has a controller and several dispensers for coins to be dispensed. The apparatus is adapted for dispensing a specific composition of coins under control of the controller from the dispensers to a portable coin receptacle. A closeable dispense space is arranged within said cabinet, and the closeable dispense space has an open state which permits reception of the portable coin receptacle to be filled, and a closed state which permits dispensing of said specific composition of coins from the dispensers into the portable coin receptacle while shielding the closeable dispense space from external access during the dispensing.

The apparatus of WO-2008/024043 is large, complex, and advanced being capable of handling large volumes of coins, which renders it suitable for large retail establishments. There is, however, also a need for coin deposit and dispensing apparati in smaller retail establishments. The demands on such an apparatus are different in such smaller establishments. A small size and a lower price are important. There is therefore a need for a more compact but still efficient coin deposit and dispensing apparatus.

SUMMARY OF THE INVENTION

In a first aspect, the present invention provides a coin deposit and dispensing apparatus comprising a cabinet serving as an apparatus housing for said apparatus;

a control means for controlling said apparatus;

a cash processing module adapted to receive a deposited mass of coins, said module optionally including a coin acceptance module for processing said deposited mass of coins; and a plurality of dispensers for coins to be dispensed, said dispensers each comprising a hopper mounted on an ejector/counter, said each of said hoppers having an upper part receiving pre-sorted coins or coins from said coin acceptance module and a lower part connected the ejector/counter;

wherein, in a deposit operation, said dispensers are adapted to receive said deposited and optionally processed mass of coins for buffering therein; and wherein, in a dispensing operation, said dispensers are adapted to dispense a specific composition of coins, under control of said control means, to a portable coin receptacle at a dispense location, wherein there is a till filling distributor unit comprising a set of a plurality of releasably mounted till filling distributors, each till filling distributor comprising a wide upper opening, a narrow lower opening, and a pipe-like structure between these openings, wherein the till filling distributor unit is designed in such a way that in a dispensing operation a till filling distributor is located below each dispenser involved in the dispensing operation, whereby each till filling distributor is adapted for receiving coins from a dispenser located above said distributor into the wide upper opening of the distributor and to guide the coins through said narrow opening to a portable cash receptacle.

In a second aspect, the present invention provides a till filling distributor suitable for receiving coins from a coin dispenser and releasing coins to a coin receptacle, said till filling distributor comprising a wide upper opening for receiving coins from a dispenser, a narrow lower opening for releasing coins into said portable coin receptacle, and a pipe-like structure between these openings, said till filling distributor being adapted for being releasably, preferably slidably mounted in a till filling distributor unit, wherein the openings have a substantially rectangular cross-section.

In a third aspect, the present invention provides a kit comprising a plurality of till filling distributors according to the second aspect.

In a fourth aspect, the present invention provides use of a till filling distributor according to the second aspect or a kit according to the third aspect for guiding coins from a coin dispenser to a coin receptacle in a coin deposit and dispensing apparatus.

DETAILED DESCRIPTION OF THE INVENTION

The present invention provides a solution to the above indicated problems. Accordingly the invention provides a more compact but still efficient coin deposit and dispensing apparatus.

In a first aspect, the present invention provides a coin deposit and dispensing apparatus comprising a cabinet serving as an apparatus housing for said apparatus;

a control means for controlling said apparatus;

a cash processing module adapted to receive a deposited mass of coins, said module optionally including a coin acceptance module for processing said deposited mass of coins; and a plurality of dispensers for coins to be dispensed, said dispensers each comprising a hopper mounted on an ejector/counter, said each of said hoppers having an upper part receiving pre-sorted coins or coins from said coin acceptance module and a lower part connected the ejector/counter;

wherein, in a deposit operation, said dispensers are adapted to receive said deposited and optionally processed mass of coins for buffering therein; and wherein, in a dispensing operation, said dispensers are adapted to dispense a specific composition of coins, under control of said control means, to a portable coin receptacle at a dispense location, wherein there is a till filling distributor unit comprising a set of a plurality of releasably mounted till filling distributors, each till filling distributor comprising a wide upper opening, a narrow lower opening, and a pipe-like structure between these openings, where the till filling distributor unit is designed in such a way that in a dispensing operation a till filling distributor is located below each dispenser involved in the dispensing operation, whereby each till filling distributor is adapted for receiving coins from a dispenser located above said distributor into the wide upper opening of the distributor and to guide the coins through said narrow lower opening to a portable cash receptacle.

A cabinet suitable in accordance with the present invention has a reduced size compared to ordinary coin deposit and dispensing apparati. Typically, the cabinet could be arranged on a table. Moreover, the cabinet is typically a metal construction of a quality ordinary used in relation to this type of machine.

As disclosed herein, the term "control means" primarily relates to a means for connecting to an external control unit, such as a personal computer, a network or similar. Typically said means for connecting the apparatus to an external control unit is a set of cable connections or a means for enabling wire-less connection. The machine may also be controlled by an internal control unit that optionally is connected to an external network or an external computer. In order to minimize size of the coin deposit and dispensing apparatus, it is preferred that the machine only contains means for connecting it to an external control unit. It is easy for the skilled person to select suitable wire-less or cable-based connection solutions.

As disclosed herein, the term "coin acceptance module adapted to receive and process a deposited mass of coins" typically relates to a module for receiving, validating and sorting coins of different types. An example of a suitable such coin acceptance module can be found in the above mentioned WO-2008/024043. However, any such coin acceptance module of reasonable size where the coins are sorted and where the sorted coins are dispensed at specific locations along a straight line could be used in accordance with the present invention.

In one embodiment, the cash processing module simply allows the user to deposit pre-sorted coins directly into the coin dispensers.

As disclosed herein, the term "till filling distributor" relates to a stiff tube or hopper structure having a wide opening and a narrow opening. The function of the till filling distributor is to guide coins from a dispenser to a portable cash receptacle. The terms "wide" and "narrow" are not associated with any particular size. What is important is that the opening facing the dispenser is sufficiently wide in order to be able to receive all coins dispensed from the dispenser. Similarly, what is important is that the opening facing the portable cash receptacle is sufficiently narrow in order to guide coins into a desired compartment of a portable cash receptacle. As disclosed herein, the term "till filling distributor unit" relates to the part of the coin deposit and dispensing apparatus where a set of a plurality of releasably mounted till filling distributors is located. The term "set of till filling distributors" relates to the collection of till filling distributors that is needed in order to process a desired amount of coins. Typically such a set comprise till filling distributors having different designs. The composition of till filling distributors in a particular set is chosen based on the amount of coin types that is to be processed and on the design of the particular portable cash receptacle that is to be used.

Preferably, the openings of each of said releasably mounted till filling distributors have a substantially rectangular cross-section.

Preferably the set of till filling distributors comprise at least one till filling distributor for which the centre of the narrow lower opening is not located directly below the centre of the wide upper opening. Preferably, the cross-section of the upper opening of the at least one till filling distributor only partially overlaps the cross-section of the lower opening of the distributor in a view from above.

Preferably, the till filling distributors are releasably mounted in a frame means. Preferably, the till filling distributors are adapted to be releasably mounted in a plurality of configurations and positions within said frame means.

In particular, the till filing distributors are slidably mounted in said frame means.

Preferably the frame means is slideably mounted in the apparatus

Preferably, the control means is a means for connecting the apparatus to an external control unit, such as a personal computer or a network, selected from a set of cable connections or a means for enabling wire-less connection.

Preferably, said plurality of dispensers are arranged in two parallel rows. In the till filling distributor unit, a till filling distributor is arranged below each dispenser.

Preferably, the dispensers are also arranged in a zig-zag pattern.

The dispensers of said apparatus are adapted for receiving coins that have been sorted and dispensed by said coin acceptance module. The received coins are buffered in the hopper part of the dispensers and dispensed from the ejector/counter part thereof. Buffer capacity determining means may be provided for each dispenser, the external control function controlling the apparatus using said control means being adapted to detect when a buffer capacity of a particular dispenser exceeds a threshold value. In case the threshold value is exceeded for a particular coin type, the external control function controlling the apparatus using said control means may instruct the coin acceptance module to reject coins of that type until the buffer capacity of the particular dispenser has been reduced to an acceptable value.

Preferably each of said upper parts of said hoppers of said plurality of dispensers has a spout part.

As already mentioned, each of said plurality of dispensers are preferably arranged in two parallell rows and said spout parts are designed in such a way that the spout part of one dispenser is in direct contact with at least one spout part of another dispenser and that there is no empty space between the upper parts of said hoppers of said dispensers when they are arranged in two parallell rows.

In some embodiments, said portable coin receptacle is a cash till comprising a plurality of compartments. Such a cash till may also have compartments for notes. The releasably mounted hoppers can be arranged in such a way that coins dispensed from a specific dispenser are directed to a specific compartment. In some embodiments, a plurality of dispensing locations are provided, each dispensing location being adapted for receiving a portable coin receptacle, typically a coin cup. In this case, the portable coin receptacle or coin cup typically only comprise one compartment.

It is to be noticed that there are no particular limitations as regards the specific composition of coins which is dispensed to the portable coin receptacle. Generally, any combination of coins of one or more types (such as one or more denominations of coins from one or more currencies) and in one or more amounts is possible. The dispensers are not limited to a particular number, and there in no particular limitations in the relation between the number of dispensers, what type of coins they handle and how such types of coins are received in the portable cash receptacle.

Moreover, the term "coins" is to be interpreted as encompassing monetary coins but also similar value-representing objects such as markers or tokens.

In a second aspect, the present invention provides a till filling distributor suitable for receiving coins from a coin dispenser and releasing coins to a coin receptacle, said till filling distributor comprising a wide upper opening for receiving coins from a dispenser, a narrow lower opening for releasing coins into said portable coin receptacle, and a pipe-like structure between these openings, said till filling distributor being adapted for being releasably, preferably slidably mounted in a till filling distribution unit, wherein the openings have a substantially rectangular cross-section.

Preferably, the centre of said narrow lower opening is not located directly below the centre of said wide upper opening. The till filling distributor is preferably adapted for being mounted in the till filling distributor unit in a plurality of configurations and positions.

Preferably, the cross-section of the upper opening of said till filling distributor only partially overlaps the cross-section of the lower opening in a view from above.

In a third aspect, the present invention provides a kit comprising a plurality of hoppers according to the second aspect.

In a fourth aspect, the present invention provides use of a hopper according to the second aspect or a kit according to the third aspect for guiding coins from a coin dispenser to a coin receptacle in a coin deposit and dispensing apparatus.

Other objectives, features and advantages of the present invention will appear from the following detailed disclosure as well as from the drawings.

Generally, all terms used in the claims are to be interpreted according to their ordinary meaning in the technical field unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The present invention will now be further disclosed with reference to the enclosed figures, in which.

DESCRIPTION OF PREFERRED EMBODIMENTS

Figure 1:
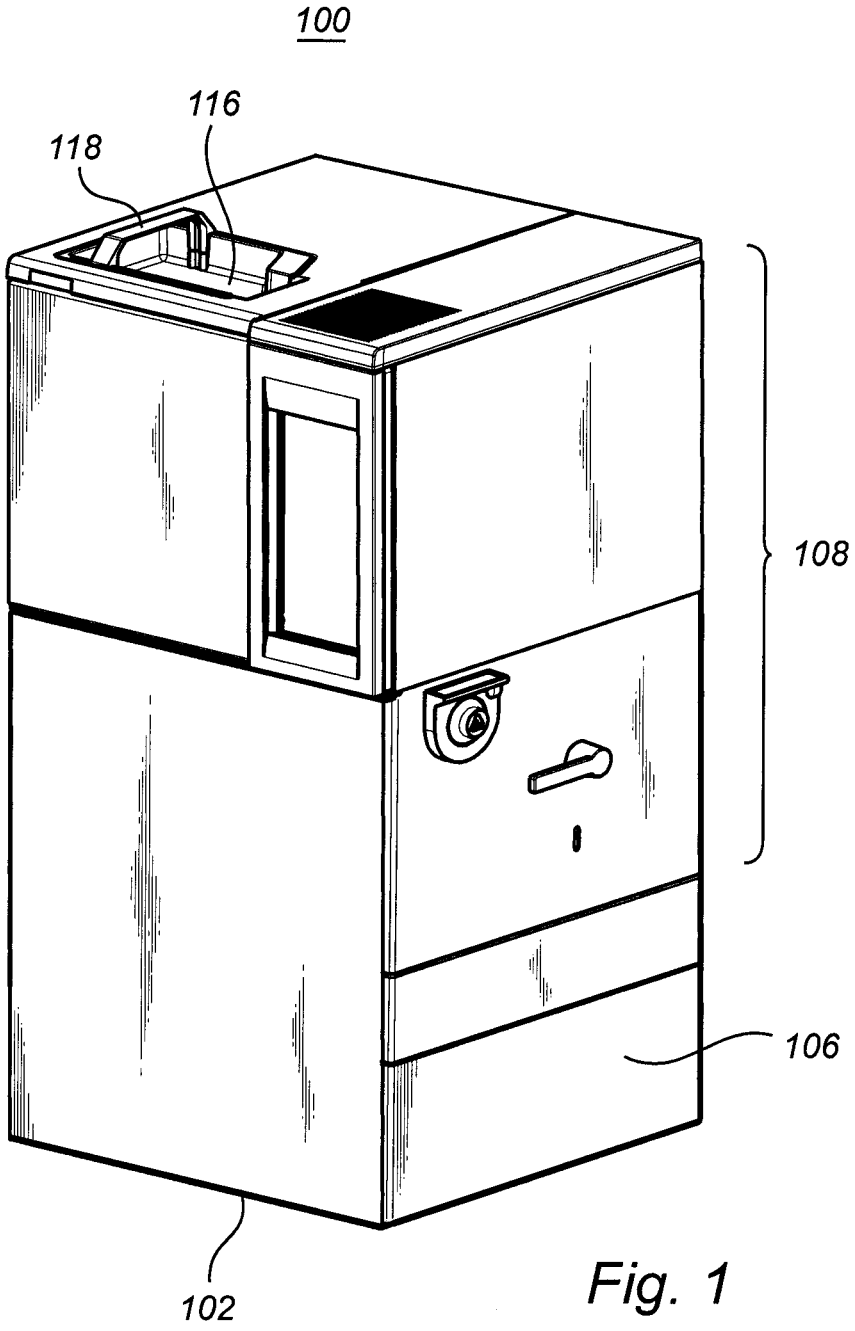
FIGS. 1-4 are perspective front views of a cash deposit and dispensing apparatus according to the present invention.

FIG. 1 illustrates a coin deposit and dispensing apparatus 100 in accordance with the present invention. The apparatus is comprised in a single cabinet 102 and includes several combined modules, each filling one or more specific functions. It is emphasized that the combination of modules, as well as functions within an individual module is not the only possible alternative. Modules and functions within individual modules can be added, altered, and excluded without leaving the inventive concept as defined by the appended claims.

The apparatus 100 generally consists of two main modules: a cash dispensing module 106 at the bottom and a cash processing module 108 at the top. These modules 106, 108 are divided into submodules and will be described in the following.

The purpose of the apparatus 100 is to simplify and render more effective the handling of cash in general and coins in particular. Instead of sending all incoming coins from customers to a remote bank or CIT (Cash in Transit) company and thereafter receiving coins for daily operation from the same bank, etc., the apparatus 100 renders it possible to recirculate coins from customers to the highest possible extent. This reduces costs related to CIT operations and work related to handling and maintenance. Further, the apparatus 100 simplifies the daily handling of coins. The apparatus 100 has two main operations: coin deposit (where coins are input by a user and then optionally counted, optionally sorted and buffered) and coin dispensing (where coins buffered in the apparatus are dispensed to a user).

The apparatus is controlled by an external means for control (not shown) which typically is a personal computer. The apparatus is connected to the external means for control by a control means which could be a set of cables and/or means for enabling wire-less connection (not shown). The connection could be of the plug-and-play type or could require a set-up procedure. The apparatus 100 is then controlled by running a specific software on the computer and using the specific interface encoded by the software.

In one embodiment, the user deposits coins into the apparatus by simply fill pre-sorted coins directly into one or more individual coin dispensers 142. This embodiment is not shown in the enclosed figures. Here, the function of the cash processing module is simply to allow the user to deposit the coins in the apparatus 100.

When depositing coins in another embodiment, the user typically empties a till into a coin input tray 116. The contents of such a till can be a mixed mass of coins, valid as well as invalid, as well as foreign material such as paper clips, dust etc. Note that valid coins could include more than one currency (including tokens, jubilee coins, gift coins and such). The end-user may then tilt the tray 116 by lifting it by the handle 118, thereby causing the contents to slide down the bottom surface of the tray 116 and into the interior of the cash processing module 108.

Figure 2:
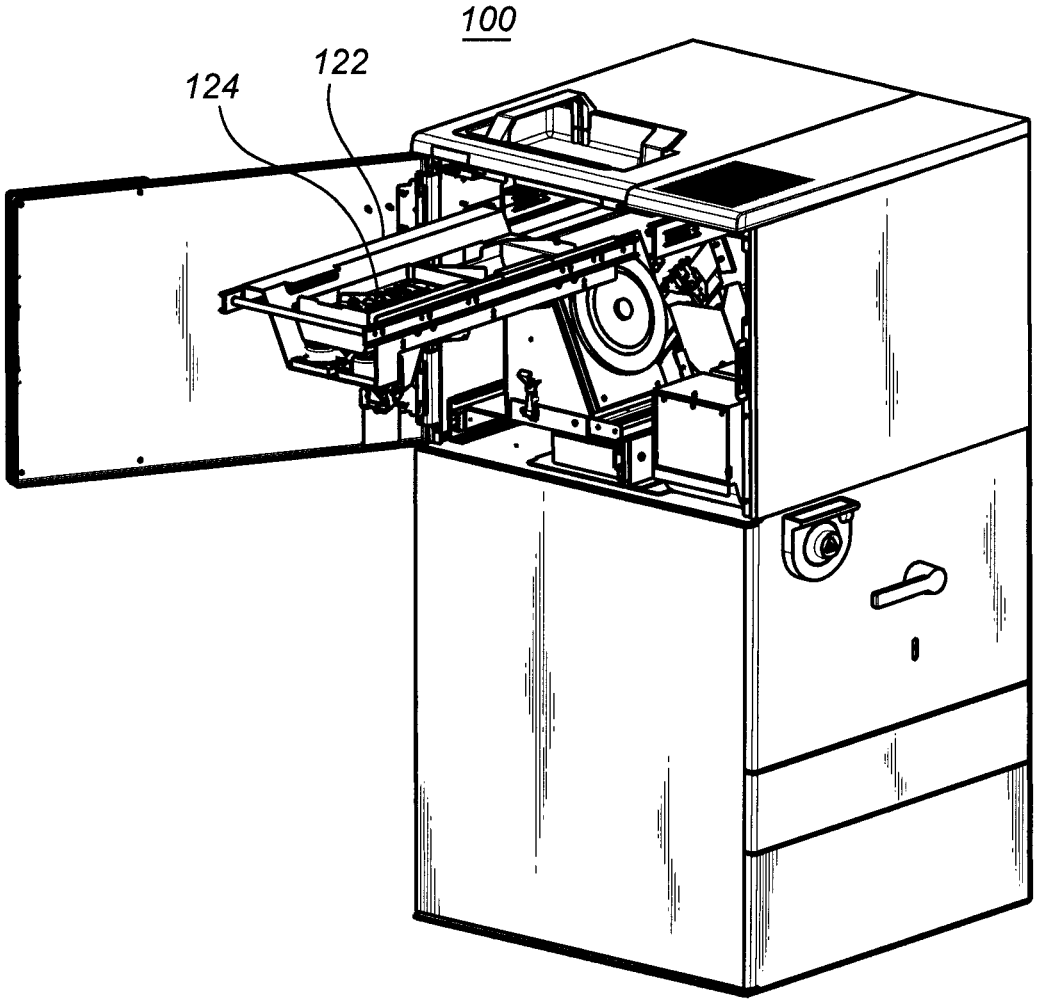

In the cash processing module 108, the contents may first pass an automatic coin conditioning (ACC) unit 122. This unit is shown in greater detail in FIG. 2. Like most other submodules the ACC unit 122, when present, is slidably arranged on a pair of rails so that it can be retractably pulled out from the interior of the cabinet 102. In FIG. 2 the ACC unit 122 is shown in the pulled-out state. The ACC unit involves a vibratory arrangement of perforated plates 124. This arrangement will separately foreign matter from the mass of coins. When the cash has been conditioned in the ACC it is forwarded to a cash acceptance module (CAM) 126.

Figure 3:
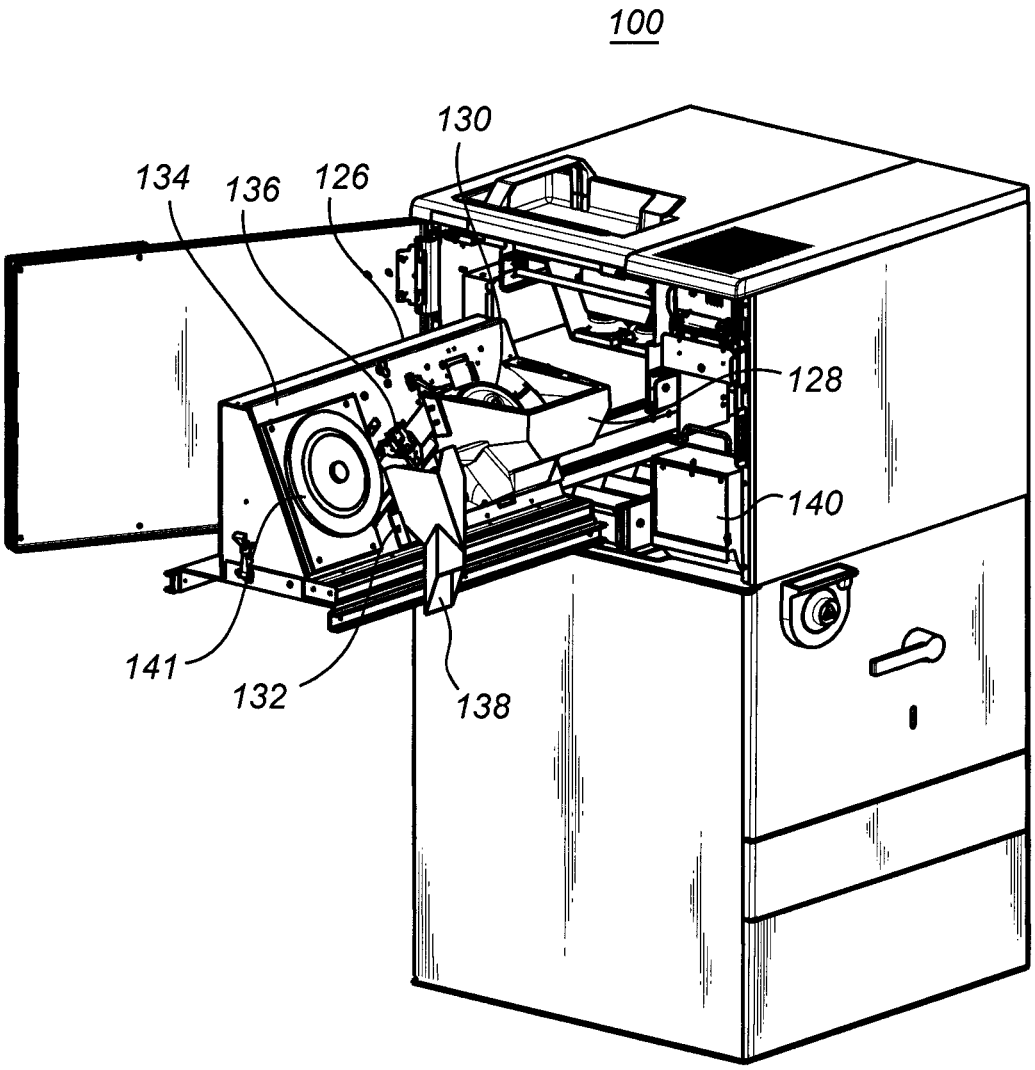

The optional cash acceptance module 126 is shown in greater detail in FIG. 3, in a pulled-out state, similar to the ACC unit of FIG. 2. One purpose of the CAM 126 is to separate valid coins from invalid ones. The CAM 126 also serves the purpose of determining the type (for instance denomination) of the valid coins, to count the number of valid coins of each type (denomination), and to sort them, thus enabling full control of transactions occurring thus far in the apparatus 100. The ACC 122 forwards the conditioned coins to a hopper bowl 128 via a receiving tray (not shown). A rotary flexible disc 130 is provided in the hopper bowl 128 and acts to pick up individual coins and bring them to the beginning of a downwardly sloping coin rail 132, mounted to a backwardly inclined front plate 134 of the CAM 126. Each coin will roll, by gravity, down the coin rail 132 and past a coin sensor unit 136.

The coin sensor unit 136, when present, will detect certain physical properties of the passing coin, such as conductivity, permeability, diameter and thickness, and compare these to prestored coin reference data in a memory by way of a processor in or coupled to the CAM 126. If the comparison fails to identify the coin as a coin of a valid denomination, it will be regarded as invalid and be deflected through a reject channel 138 to a cash reject area 140.

If on the other hand a valid denomination has been established for the coin, its denomination or associated value will be recorded and sent to the external means for control. It will be used later when calculating a total value for all valid coins processed during the coin deposit transaction upon its completion.

Figure 4:
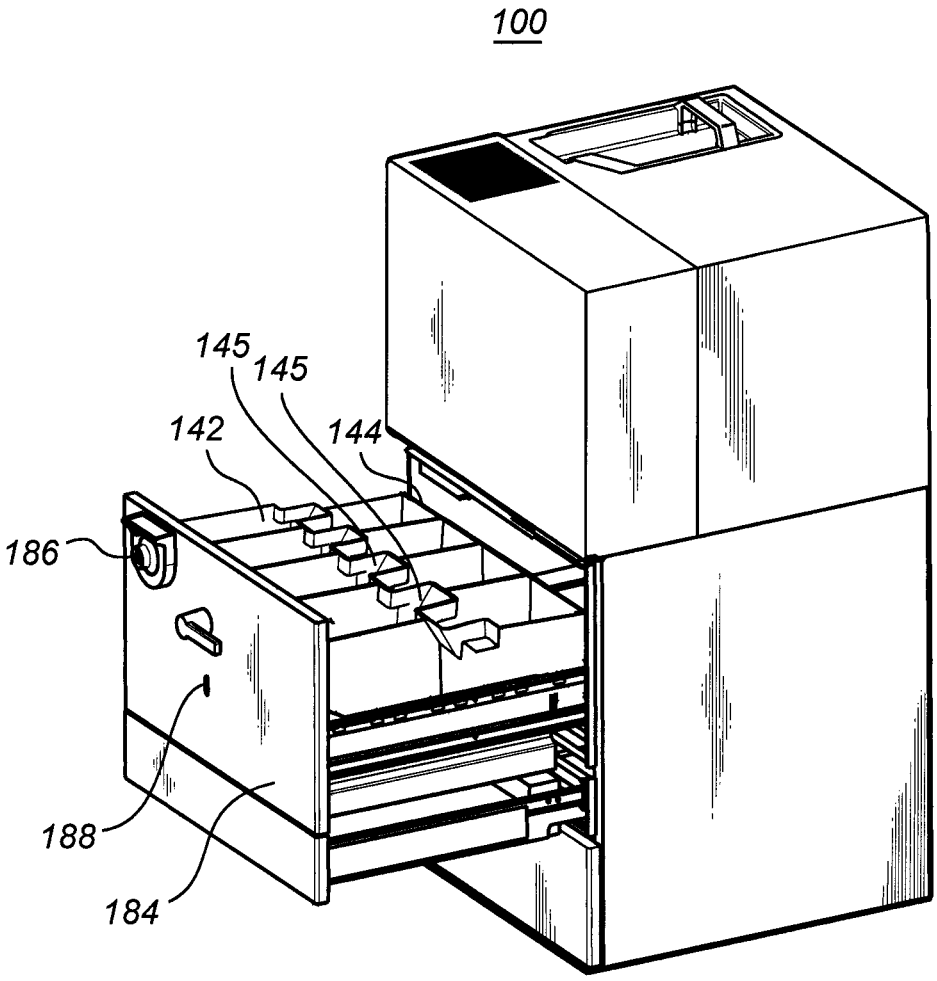

Valid coins roll down the rail 132 and are transported by a rotary carrier disc 141 along a circular sorting path across a series of openings in the front plate 134. The openings are of increasing size, such that coins of the smallest diameter will fall down through the first opening in the transport direction, whereas coins of the second smallest diameter are separated through the next opening, etc. After passing through one of these openings, the coin is guided into a dispenser 142 of a dispenser unit 144 by one of a plurality of channels (not shown). The lower ends of all these channels are arranged on a straight line at regular intervals. The dispenser unit is shown in its pulled-out state in FIG. 4.

Note that valid coins could include more than one currency, e.g. a retail establishment could accept more than one currency (including tokens, jubilee coins, gift coins and such) as payment from its customer. The change given back to a customer, however, usually includes a single currency. This means that the CAM accepts coins that are not to be dispensed at a later stage. These latter coins can be stored in separate dispensers 142 (by denomination/type) or a single dispenser 142. The number of coins, as well as their denomination, is registered by the controller before they enter the dispensers.

Figure 5:
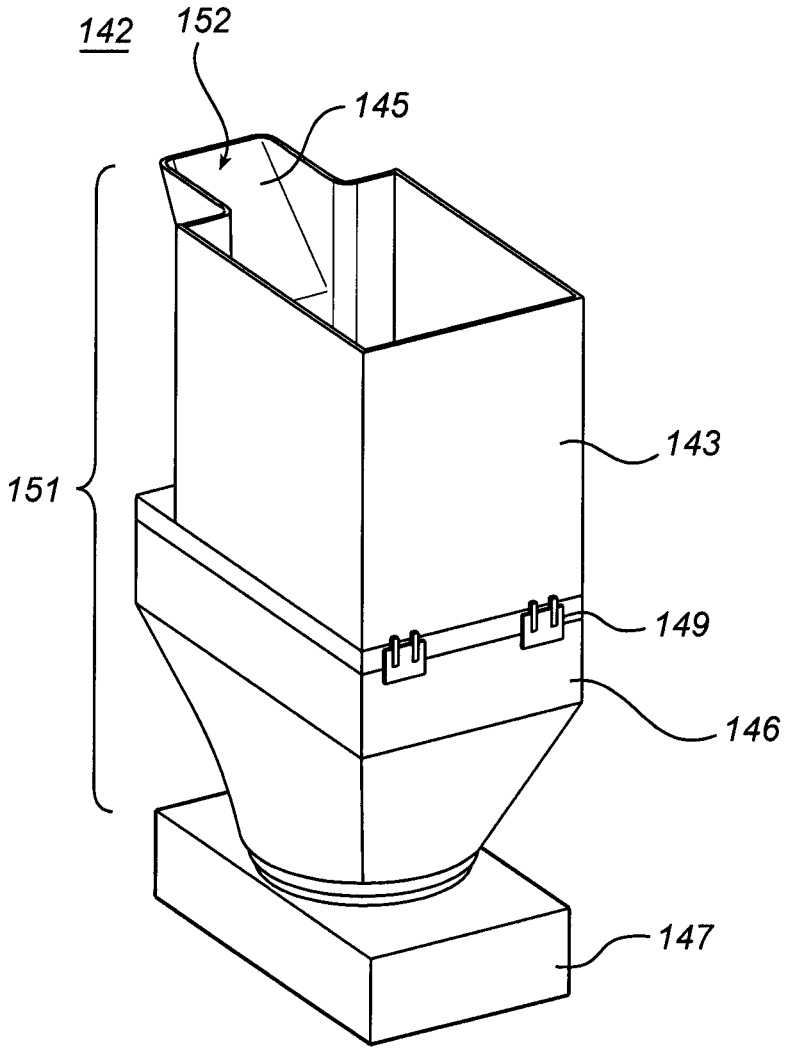
FIG. 5 is a perspective view illustrating a coin dispenser that could be used in connection with the present invention.

As visualised in FIG. 5 an individual dispenser 142 comprises three main parts, an upper part 143 (the visible part of the dispensers 142 in FIG. 4) and a lower part 146 connected the ejector/counter 147. Each dispenser 142 has a buffer capacity associated with a threshold value, usually referring to the number of coins it is allowed to contain. If, during a deposit procedure, the threshold value is reached, the coin ejector 147 associated with the dispenser 142 will typically eject one coin for each coin the dispenser 142 receives. The upper part 143 is detachably attached to the lower part 146 by means of a divisible hinge connection 149. Any other suitable means of attachment may be used.

Figure 9:
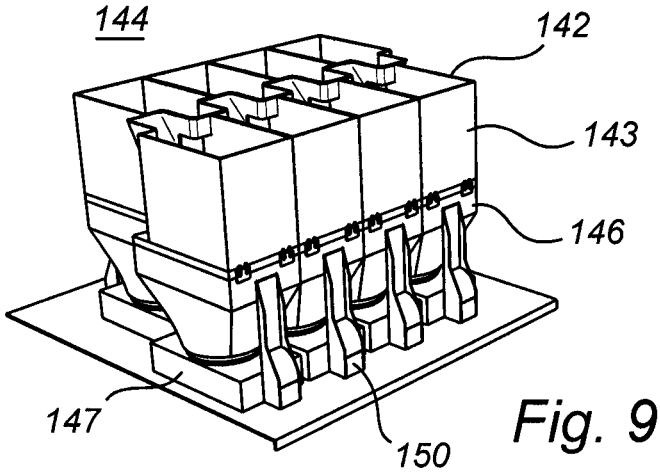
FIG. 9 shows a dispenser arrangement that could be used in accordance with the present invention.

The upper part comprises a spout 145 integrally projecting from the upper part. According to this embodiment, the shape of the spout is rectangular and it is centrically projecting from the side of the upper part, but alternative shapes and projecting positions is possible. Its shape could, for example, be triangular. The spout could project from the leftmost or rightmost part of the side it is projecting from in FIG. 5. The important thing is that the shape of the dispensers allows a plurality of dispensers to be fitted together and forming a rectilinear pattern of spouts 145. It is also advantageous that the rectilinear pattern of spouts is formed without any open space in between. This may improve the chances that a coin will fall into an inlet 152 of the spout 145 and not fall between the spouts and into the interior of the apparatus 100. The zig-zag pattern of dispensers, according to embodiments of the present invention, is clearly visible in FIG. 4 and FIG. 9.

The dispensing operation will now be described.

Figure 7:
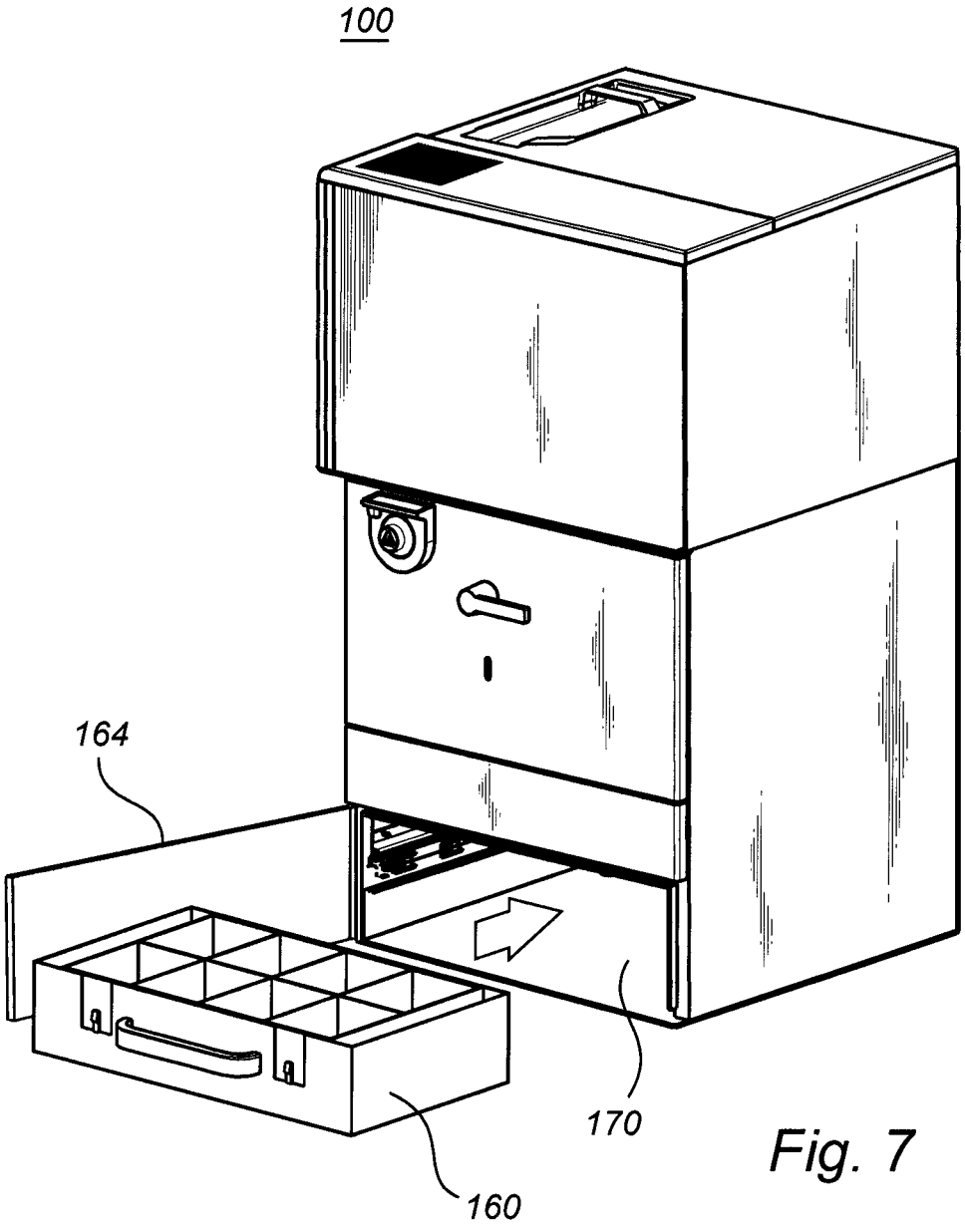
Figure 8:
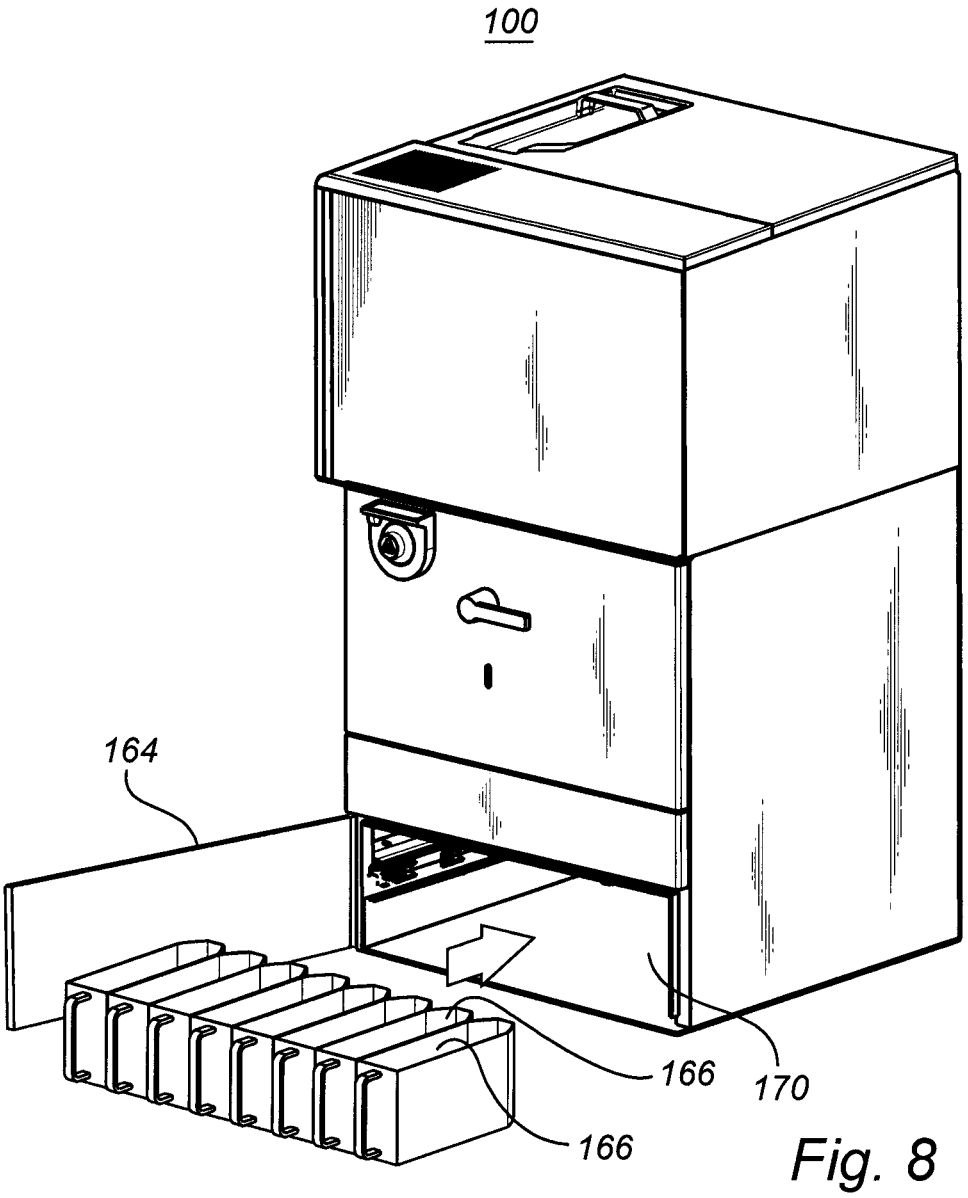

When the user wishes to fill a portable coin receptacle, such as a till 160 (see FIG. 7) having several different compartments or a coin cup 166 (see FIG. 8) having a single compartment, the user instructs the apparatus to dispense coins by entering a command on the personal computer or similar external control means. The user opens door 164 and enters the till 160 or a plurality of coin cups 166 into the filling compartment 170 of the apparatus. When the portable coin receptacle(s) are in a filling position one or more sensors (not shown) send indication to the external control means and the dispensing operation could be started.

Figure 12A:
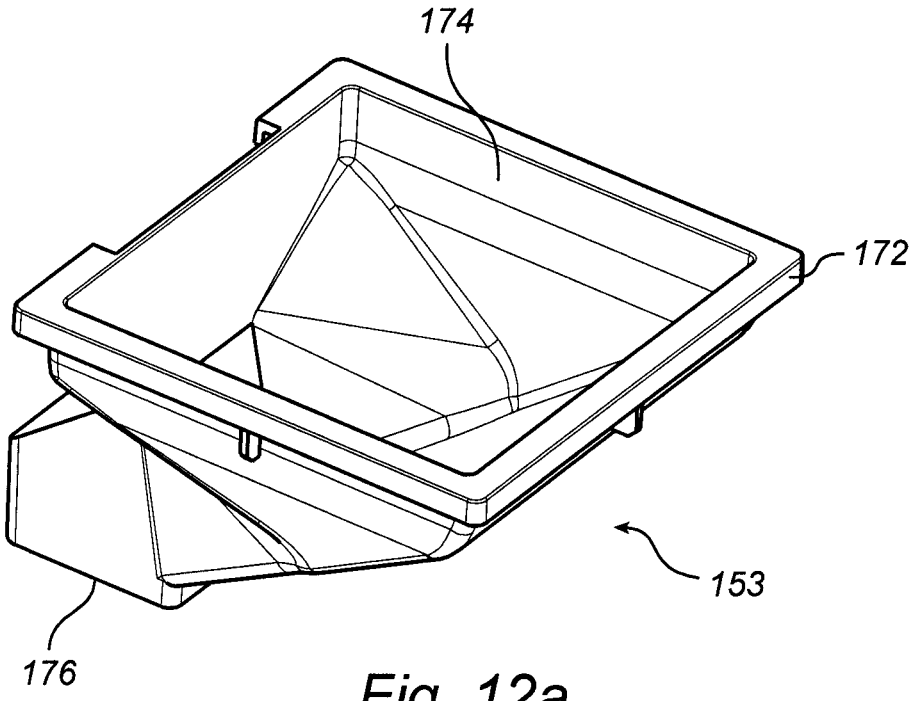
FIG. 12*a*—is a side perspective view of a hopper according to one embodiment, that could be used together with the present invention.
Figure 12B:
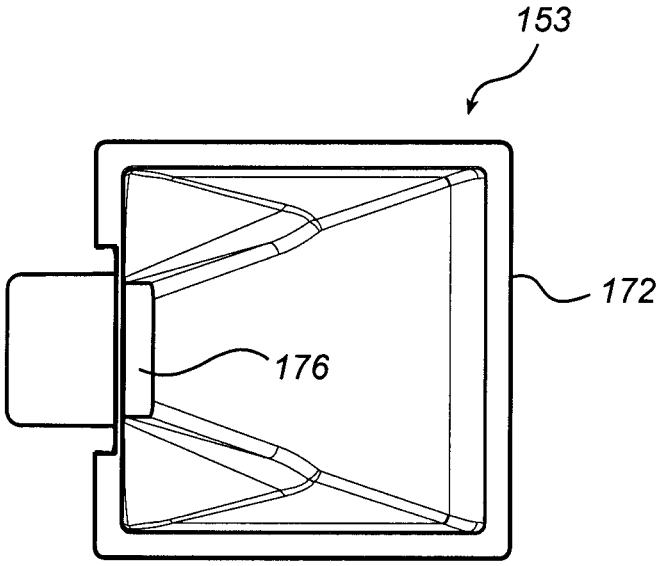
FIG. 12*b*—is a view from above of the hopper of FIG. 12*a;*
Figure 13A:
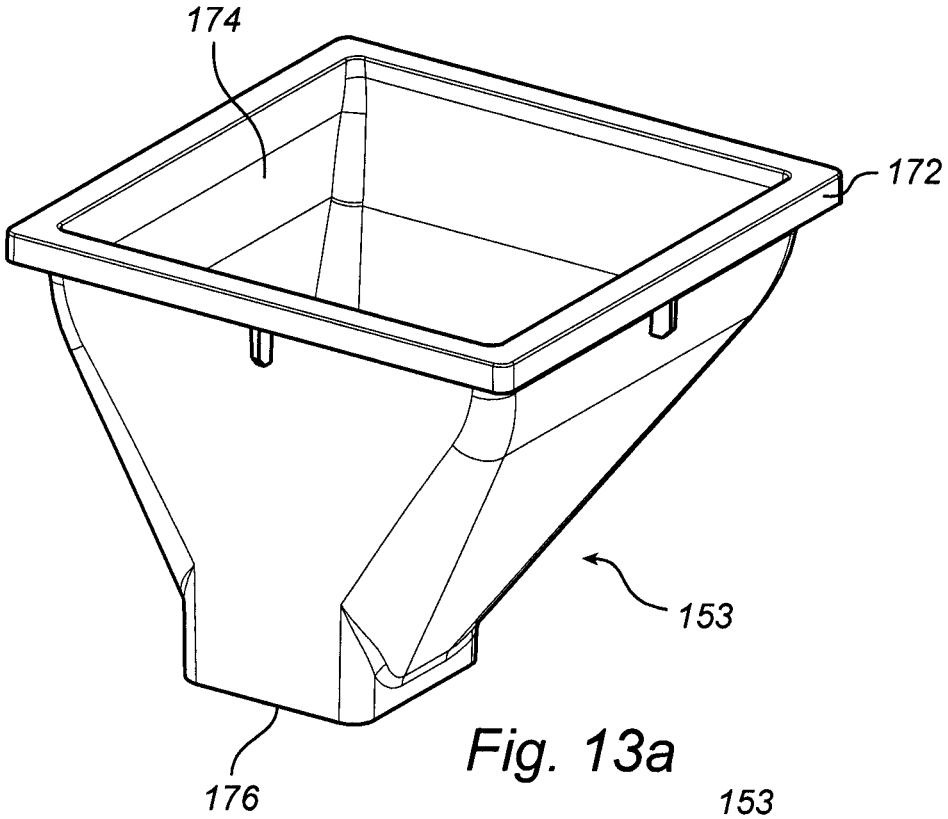
FIG. 13*a*—is a side perspective view of a hopper according to another embodiment, that could be used together with the present invention.
Figure 13B:
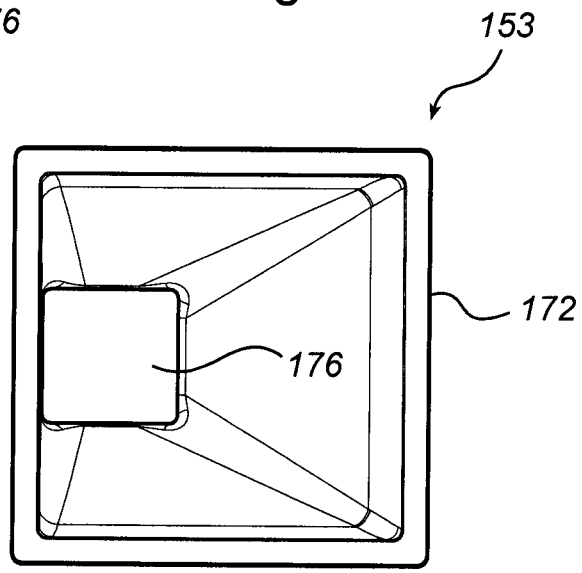
FIG. 13*b*—is a view from above of the hopper of FIG. 13*a*.

After leaving the ejector/counter part 147 of a dispenser 142, the coin falls into a till filling distributor 153. Different examples of till filling distributors are shown in a side view and a view from above in FIGS. 12*a*, 12*b*, 13*a*, and 13*b* respectively. The till filling distributor 153 has an upper opening 174 and a lower opening 176. The cross-sections of both the upper opening 174 and the lower opening 176 are square-shaped. There is a protruding edge 172 all around the upper opening 174. This protruding edge supports the hopper 142 when it is hung in a frame together with other such hoppers. In FIGS. 12*a* and 12*b*, a till filling distributor is shown where the cross-section of the upper opening 174 only partially overlaps the cross-section of the lower opening in a view from above. FIGS. 13*a* and 13*b* show a till filling distributor where the cross-section of the upper opening 174 completely overlaps the cross-section of the lower opening in a view from above. Typically, different till filling distributors are used together. A set comprising different till filling distributors where all distributors fulfill the requirements of the claims provide flexibility that is useful when different kinds of portable cash receptacles are used together with the coin deposit and dispensing apparatus.

Figure 6:
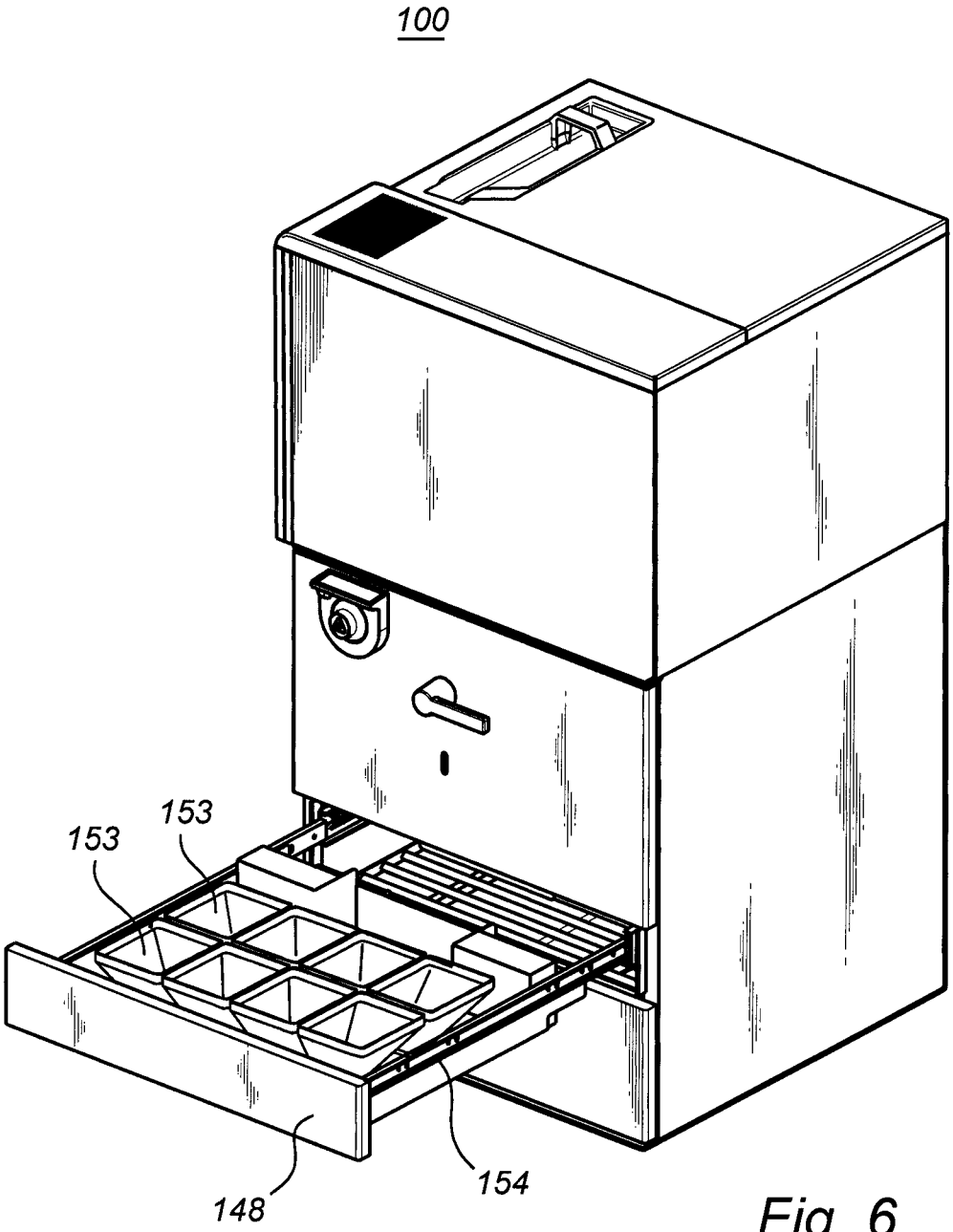
FIGS. 6-8 are views similar to FIGS. 1-4.
Figure 10:
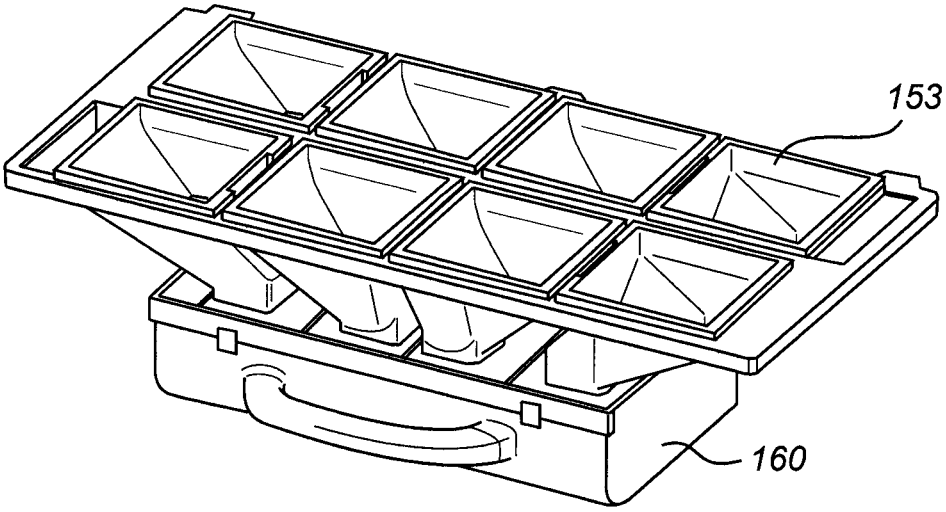
FIGS. 10-11 disclose how releasably mounted hoppers could be arranged in order to fit different kinds of portable cash receptacles.
Figure 11:
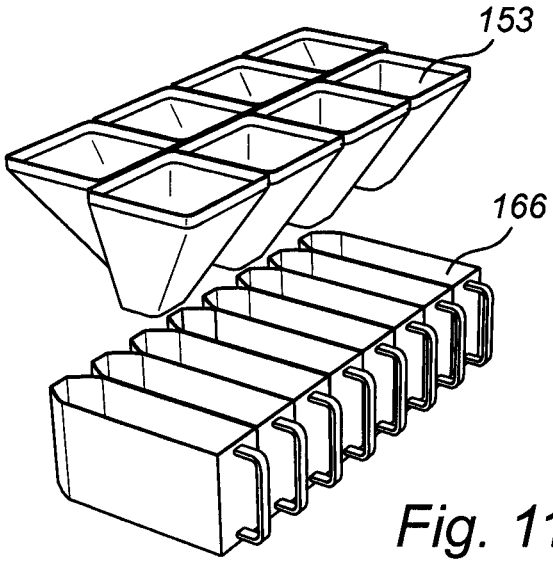

As shown in FIG. 6, a plurality of such till filling distributors 153 are releasably mounted on a slideable frame 154 behind a drawer 148 by using a fastening means. As shown in FIGS. 10 and 11, the till filling distributors 153 are used to guide the coins from the ejector/counter part 147 of a dispenser 142 into a desired compartment of a portable coin receptacle 160, 166. As is evident from the figures, the coins may be guided to another compartment/receptacle by turning/moving a particular till filling distributor 153.

The person skilled in the art realizes that the present invention by no means is limited to the embodiments described above. On the contrary, many modifications and variations are possible within the scope of the appended claims. For example, the coin input tray 116 and the handle 118 in FIG. 1 could be replaced by a hatch covering an opening into the interior of the cash processing module 108.

The invention claimed is:

1. A coin deposit and dispensing apparatus comprising a cabinet serving as an apparatus housing for said apparatus;

a control means for controlling said apparatus;

a cash processing module adapted to receive a deposited mass of coins; and a plurality of dispensers for coins to be dispensed, said dispensers each comprising a hopper mounted on an ejector/counter, said each of said hoppers having an upper part for receiving pre-sorted coins or coins from said cash processing module and a lower part connected to the ejector/counter;

wherein, in a deposit operation, said dispensers are adapted to receive said deposited mass of coins for buffering therein; and wherein, in a dispensing operation, said dispensers are adapted to dispense a specific composition of coins, under control of said control means, to a portable coin receptacle at a dispense location, characterized in that there is a till filling distributor unit comprising[a set of] a plurality of independently, releasably mounted till filling distributors, including at least a till filling distributor having a first cross-sectional design and a till filling distributor having a second cross-sectional design different from the first design, each till filling distributor comprising a wide upper opening, a narrow lower opening, and a pipe-like structure between these openings, where the till filling distributor unit is designed in such a way that in a dispensing operation a till filling distributor is located below each dispenser involved in the dispensing operation, whereby each till filling distributor is adapted for receiving coins from a dispenser located above said distributor into the wide upper opening of the distributor and to guide the coins through said narrow lower opening to a portable coin receptacle.

2. A coin deposit and dispensing apparatus according to claim 1, characterized in that the openings of each of said till filling distributors have a substantially rectangular cross-section.

3. A coin deposit and dispensing apparatus according to claim 1, characterized in that the set of till filling distributors comprise at least one till filling distributor for which the centre of the narrow lower opening is not located directly below the centre of the wide upper opening.

4. A coin deposit and dispensing apparatus according to claim 3, characterized in that the cross-section of the upper opening only partially overlaps the cross-section of the lower opening in a view from above.

5. A coin deposit and dispensing apparatus according to claim 1, characterized in that said control means is a means for connecting the apparatus to an external control unit, such as a personal computer or a network, selected from a set of cable connections or a means for enabling wire-less connection.

6. A coin deposit and dispensing apparatus according to claim 1, characterized in that said plurality of dispensers are arranged in two parallel rows and that a till filling distributor is arranged below each dispenser in the till filling distributor unit.

7. A coin deposit and dispensing apparatus according to claim 6, characterized in that the dispensers are arranged in a zig-zag pattern.

8. The coin deposit and dispensing apparatus of claim 1, wherein the cash processing module includes a coin acceptance module for processing the deposited mass of coins, and wherein, in the deposit operation, the dispensers are adapted to receive a deposited and processed mass of coins for buffering therein.

9. A coin deposit and dispensing apparatus comprising a cabinet serving as an apparatus housing for said apparatus;

a control means for controlling said apparatus;

a cash processing module adapted to receive a deposited mass of coins; and a plurality of dispensers for coins to be dispensed, said dispensers each comprising a hopper mounted on an ejector/counter, said each of said hoppers having an upper part for receiving pre-sorted coins or coins from said coin acceptance module and a lower part connected to the ejector/counter;

wherein, in a deposit operation, said dispensers are adapted to receive said deposited mass of coins for buffering therein; and wherein, in a dispensing operation, said dispensers are adapted to dispense a specific composition of coins, under control of said control means, to a portable coin receptacle at a dispense location, characterized in that there is a till filling distributor unit comprising a frame means and a plurality of independently, releasably mounted till filling distributors, each till filling distributor comprising a wide upper opening, a narrow lower opening, and a pipe-like structure between these openings, the till filling distributor unit being designed in such a way that in a dispensing operation a till filling distributor is located below each dispenser involved in the dispensing operation, wherein each till filling distributor is independently, releasably mounted in said frame means, is adapted to be independently, releasably mounted in a plurality of configurations and positions within said frame means, and is adapted for receiving coins from a dispenser located above said distributor into the wide upper opening of the distributor and to guide the coins through said narrow lower opening to a portable coin receptacle.

10. A coin deposit and dispensing apparatus according to claim 9, characterized in that said till filling distributors are slidably mounted in the frame means.

11. A coin deposit and dispensing apparatus according to claim 9, characterized in that the frame means is slidably mounted in the apparatus.

12. A till filling distributor unit suitable for receiving coins from a coin dispenser and releasing coins to one or more portable coin receptacles, said till filling distributor unit comprising a plurality of independently, releasably mounted till filling distributors, each till filling distributor comprising a wide upper opening for receiving coins from a dispenser, a narrow lower opening for releasing coins into a portable coin receptacle, and a pipe-like structure between these openings and being adapted for being independently, releasably mounted in a plurality of configurations and positions in said till filling distribution unit, wherein, the openings have a substantially rectangular cross-section, and the plurality of independently, releasably mounted till filling distributors includes at least a first till filling distributor having a first cross-sectional design and a second till filling distributor having a second cross-sectional design different from the first design.

13. A till filling distributor according to claim 12, wherein the centre of said narrow lower opening is not located directly below the centre of said wide upper opening, and wherein the till filling distributor is adapted for being independently mounted in said till filling distribution unit in a plurality of configurations and positions.

14. A till filling distributor according to claim 13, wherein the cross-section of the upper opening only partially overlaps the cross-section of the lower opening in a view from above.

15. The till filling distributor of claim 12, wherein said till filling distributor is further adapted for being slidably mounted in the till filling distribution unit.

* * * * *